United States Patent [19]

Pape et al.

[11] 4,126,921

[45] Nov. 28, 1978

[54] CURTAIN OR DRAPE PACKING, TRANSPORTING AND STORING ARRANGEMENT

[75] Inventors: Hermann Pape, Laggenbeck, Fed. Rep. of Germany; Peter Schroeder, Zurich; Rudolf Schmitz, Kastanienbaum, both of Switzerland

[73] Assignee: Gardisette Holding AG, Switzerland

[21] Appl. No.: 745,984

[22] Filed: Nov. 29, 1976

[30] Foreign Application Priority Data

Nov. 29, 1975 [DE] Fed. Rep. of Germany ..... 2553834

[51] Int. Cl.[2] ..... B25B 27/14

[52] U.S. Cl. ..... 29/281.1; 104/96; 160/330; 206/326

[58] Field of Search ..... 29/281.1; 104/96, 137, 104/89; 160/345, 330, 124, 126; 206/326

[56] References Cited

U.S. PATENT DOCUMENTS

| | | | |
|---|---|---|---|
| 3,033,127 | 5/1962 | Kuebler | 104/89 |
| 3,396,834 | 8/1968 | Luckey et al. | 206/326 |
| 3,916,975 | 11/1975 | Lawson | 160/330 |
| 3,917,065 | 11/1975 | Pape | 206/326 |

*Primary Examiner*—James L. Jones, Jr.
*Attorney, Agent, or Firm*—Craig & Antonelli

[57] ABSTRACT

An arrangement for packing, storing, transporting and hanging ready-made curtains or drapes which are provided at upper edges thereof with holding devices for fixing folds or pleats. The holding devices include coupling elements for coupling the holding devices with at least one of a number of curtain or drape hangers arranged at a mounted curtain or drape rail. The hangers include further coupling elements complementary to and cooperable with the coupling elements of the holding devices. A carrying device is provided for carrying and accommodating an entire width of a curtain or drape with detachable coupling elements being provided at the carrying device for detachably coupling the carrying device to at least one of the hangers arranged at the mounted curtain or drape rail.

26 Claims, 8 Drawing Figures

FIG. 5
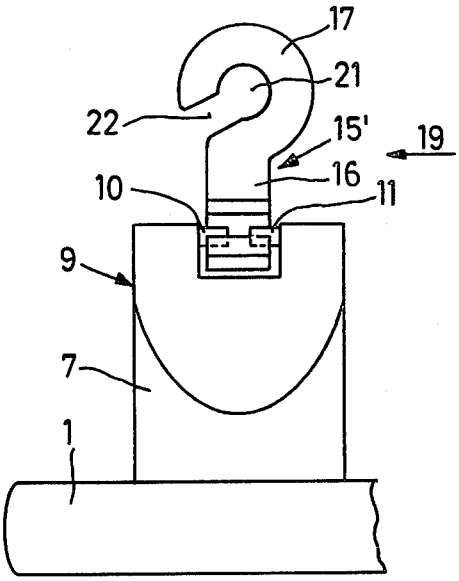
FIG. 6
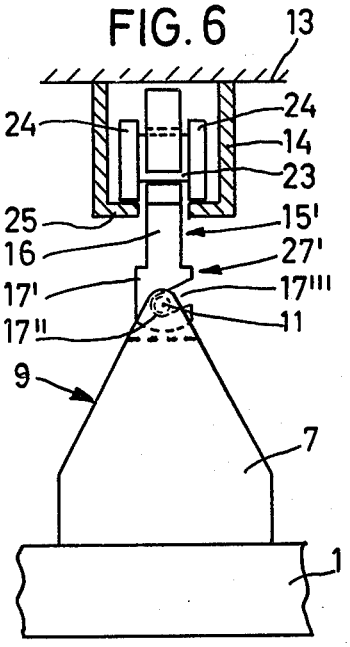
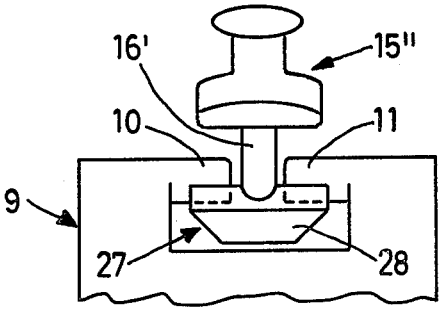
FIG. 7
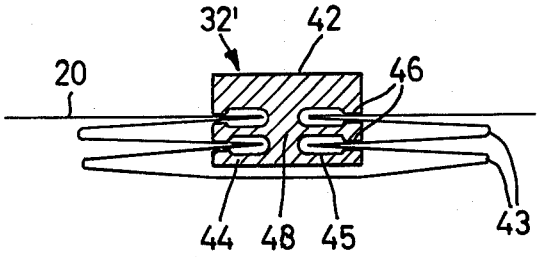
FIG. 8

CURTAIN OR DRAPE PACKING, TRANSPORTING AND STORING ARRANGEMENT

The present invention relates to a transporting, packing and storing arrangement and, more particularly, to an arrangement for transporting, packing and storing ready-made curtains, drapes or hangings which are provided at their upper edges with durably fastenable hanging devices or fittings serving to fix the folds or the like in the drapes or curtains.

A device for packing, transporting and storing ready-made curtains or drapes is disclosed, for example, in U.S. Pat. No. 3,917,065 wherein at least one rail in the form of a curtain rail is mounted on a lower side of the lid or carrier of a protective casing. The lid includes a holding handle and is also provided with a rim or lip which projects beyond the rail or rails with at least one slot or aperture being provided in the rim to permit access to the cross section of the curtain rail whereby the hanging devices or fittings mounted at the top edge of the ready-made curtain or drape can be introduced into the rail or rails. After the ready-made curtain or drape has been inserted on the rail or rails, the end of the rail or rails adjacent the slots or aperture may be closed by a suitable conventional clamping device such as customarily used for conventional curtain rails fitted to ceilings or walls in order to prevent the curtain or drape from slipping accidentally from the rail or rails before the lid carrying the curtain is fitted into the protective casing or container or after the lid has been removed from the container.

The above-noted patented construction is not only suitable for providing, storing and transporting of ready-made curtain or drapes, but also functions effectively for holding the ready-made curtain or drapes for the purpose of washing.

In commonly assigned U.S. application Ser. No. 631,197, the subject matter of which is incorporated herein by reference to the extent necessary in understanding the present invention, hanging devices are provided, each of which includes a holding device adapted to be durably fastened to an upper edge of a ready-made curtain or drape and a hanger mounted for sliding in a curtain rail with the hanger and the holding device having complementary coupling parts whereby they are detachably connected to one another.

The aim underlying the present invention essentially resides in further developing the above-noted device for packing, transporting and storing ready-made drapes in such a manner that a subsequent hanging or detachment of the ready-made curtain or drape from a curtain rail mounted on the ceiling of the room is greatly facilitated.

According to one feature of the present invention, a drape or curtain carrying member is provided with at least one upwardly projecting coupling member adapted to be selectively coupled with hangers arranged in a curtain or drape rail mounted on the ceiling of the room. By virtue of this arrangement, the drape or curtain carrying member may be temporarily mounted on the mounted rail so that the drapes or curtains on the carrying member may be suspended from the mounted rail and subsequently transferred from such carrying member to the mounted rail.

Likewise, to remove a curtain or drape from the mounted curtain rail, the carrying member may be temporarily coupled to the mounted rail and the curtain or drape removed from the mounted rail to the carrying member. The provision of the carrying member eliminates the tedious holding of the curtain or drape during a hanging or removal of the same and also permits free use of both hands by the user of the carrying member.

Moreover, transfer to or from the carrying member can be effected at any convenient accessible point on the mounted curtain or drape rail and no special adaptation of the conventional curtain rail is necessary.

The carrying member of the present invention is adapted to be temporarily coupled to one or more hangers arranged in the mounted curtain or drape rail and, for most applications, a coupling to two hangers would be sufficient. Preferably, the upwardly projecting coupling member corresponds to a coupling part provided on the holding devices of the curtain or drape.

According to a further advantageous feature of the present invention, the carrying member is provided with at least one drape or curtain mounting rail to accommodate the holding devices provided on the drapes or curtains when transferred to and from the rail mounted on the ceiling. To accommodate various widths of the curtain or drape while minimizing the size of the carrying member, the rail provided on the carrying member may be disposed in a U-shaped manner. To accommodate larger width drapes while maintaining the minimum size of the carrying member, the rail provided thereat may also be arranged so as to define an S-shape or a spiral path.

According to another feature of the present invention, the rail provided on the carrying member is fashioned so as to accommodate a coupling part mounted on the holding devices provided on the curtains or drapes whereby it is unnecessary to provide a separate device on the holding device to enable the provided holding devices and, consequently, the curtains or drapes carried by them to be readily mountable in the rail of the carrying member.

One advantage of the carrying member of the present invention resides in the fact that such member may not only be used solely as an aid in hanging or removing curtains or drapes, but also the carrying member may be used as an aid in washing or cleaning since the curtain or drape is arranged on the carrying member in an orderly manner.

If washing or cleaning is to be effected manually in a bath or the like, as is advisable in the case of large, heavy articles since ordinary domestic washing machines are not large enough to take large heavy curtains or drapes, the curtain or drape will lie neatly in the bath during the washing or cleaning process.

If the washing or cleaning is to be effected in a machine, the curtain or drape would then be removed from the rail of the carrying member and introduced into the machine without the carrying member. After the cleaning or washing operation, the curtain or drape would then be inserted onto the rail of the carrying member and the carrying member could then be mounted on a curtain rail provided on the ceiling at a suitable point whereby the curtain or drape could be left there to drip dry without the floor having to be covered with towels or the like over the entire length of the curtain rail.

Consequently, the utilization of the carrying member in accordance with the present invention minimizes if not avoids the chances of the user becoming wet during the washing or cleaning process and the remounting of the carrying member to the mounted curtain rail.

A further advantageous feature of the present invention resides in the fact that a carrying member may also be used for storing curtains or drapes at a dealer or store. For this purpose, curtains or drapes delivered by the manufacturer in a completely ready-made state are inserted onto the rail of the carrying member and stored not only in a space-saving manner, but also stored in a hanging condition thereby preventing the formation of undesirable creases in the curtains or drapes while awaiting delivery to the final purchaser.

To minimize expenses when a plurality of different coupling systems are employed, according to yet another advantageous feature of the present invention, the coupling member or members may be mounted on a cover or lid of a storage or transporting container for the drapes or curtains and made in one piece with such cover or lid.

If the carrying member is to serve at the same time as the cover or lid of the packing unit for the drape or curtain, constructed, for example, in accordance with U.S. Pat. No. 3,917,065, it is particularly advantageous in accordance with the present invention for the coupling member or members of the carrying member to be detachably mounted on the carrying member so that they can be fastened subsequently in a simple manner thereby in no way impairing the stackability of the packing unit.

Accordingly, it is an object of the present invention to provide a device for packing, transporting and storing ready-made curtains or drapes which facilitates the hanging and removal of the drapes from a mounted curtain or drape rail without the use of excessive strength.

A further object of the present invention resides in providing a device for packing, transporting and storing ready-made curtains or drapes which minimizes if not avoids the formation of undesirable creases in the curtains or drapes.

A still further object of the present invention resides in providing a device for packing, transporting and storing ready-made curtains or drapes which is relatively simple in construction and therefor inexpensive to manufacture.

These and other objects, features and advantages of the present invention will become more apparent from the following description when taken in connection with the acompanying drawings which show, for the purposes of illustration only, several embodiments in accordance with the present invention, and wherein:

FIG. 5 is a frontal view, on an enlarged scale, of a modified hanger arrangement for the carrying member of the present invention;

FIG. 6 is a lateral view of the hanger arrangement of FIG. 5 arranged in a mounted curtain or drape rail;

FIG. 7 is a frontal view, on an enlarged scale, of a further modified hanger arrangement for the carrying member of the present invention; and FIG. 8 is a horizontal cross-sectional view of a modified holding device for a carrying member in accordance with the present invention.

Figure 1:
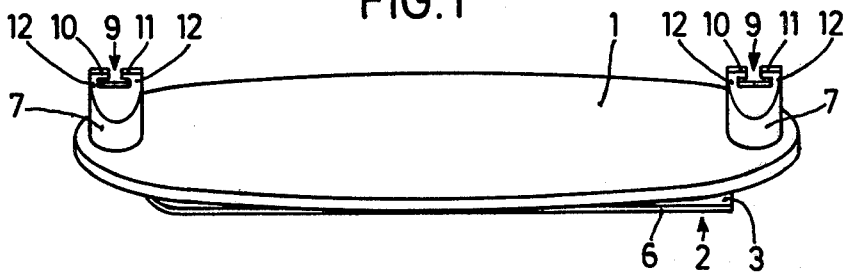
FIG. 1 is a perspective view of a carrying member for ready-made drapes or curtains in accordance with the present invention.
Figure 2:
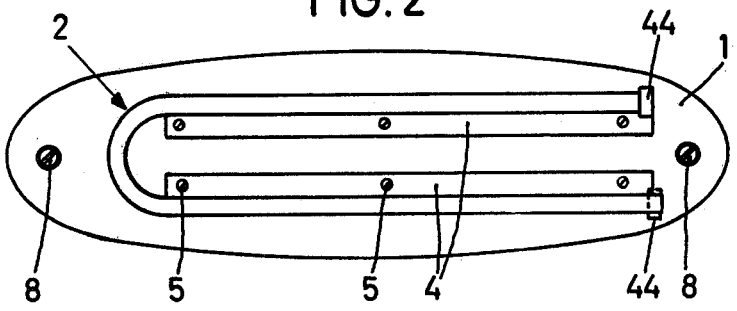
FIG. 2 is a bottom view of the carrying member of FIG. 1.

Referring now to the drawings wherein like reference numerals are used throughout the various views to designate like parts and, more particularly, to FIGS. 1 and 2, according to these figures, a carrying part or member 1 formed, for example, as a narrow elliptical plate has fastened, on a lower side thereof, a T-shaped rail generally designated by the reference numeral 2 arranged so as to define a U-shaped path. The rail 2 includes a central vertically disposed web 3 provided at its upper end with a flange 4 laterally bent over and secured to the lower face of the member 1. The fastening of the rail 2 may be effected by screws 5 or, alternatively, a plug connection or welding may be employed to secure the rail 2 to the member 1. Laterally projecting cross webs 6 are formed at the lower end of the web 3 so that the rail 2 is fastened as a conventional drape or curtain rail.

Two spaced suspension elements or pins 7 are disposed on the upper face of the carrying member 1 and are detachably secured thereto by, for example, screws 8 or a bayonet fastening (not shown). The hanging pins 7 include a first substantially cylindrical part at the area of connection of the member 1 and are provided at their respective free ends with a coupling part generally designated by the reference numeral 9.

Each of the parts 9 includes two aligned inwardly directed projections or pins 10, 11 arranged on cheeks or lateral projections 12 provided on an upper surface of the suspension pin 7. Preferably, the suspension pin and the coupling part are made in one piece from a hard-elastic thermoplastic synthetic resinous material.

Figure 3:
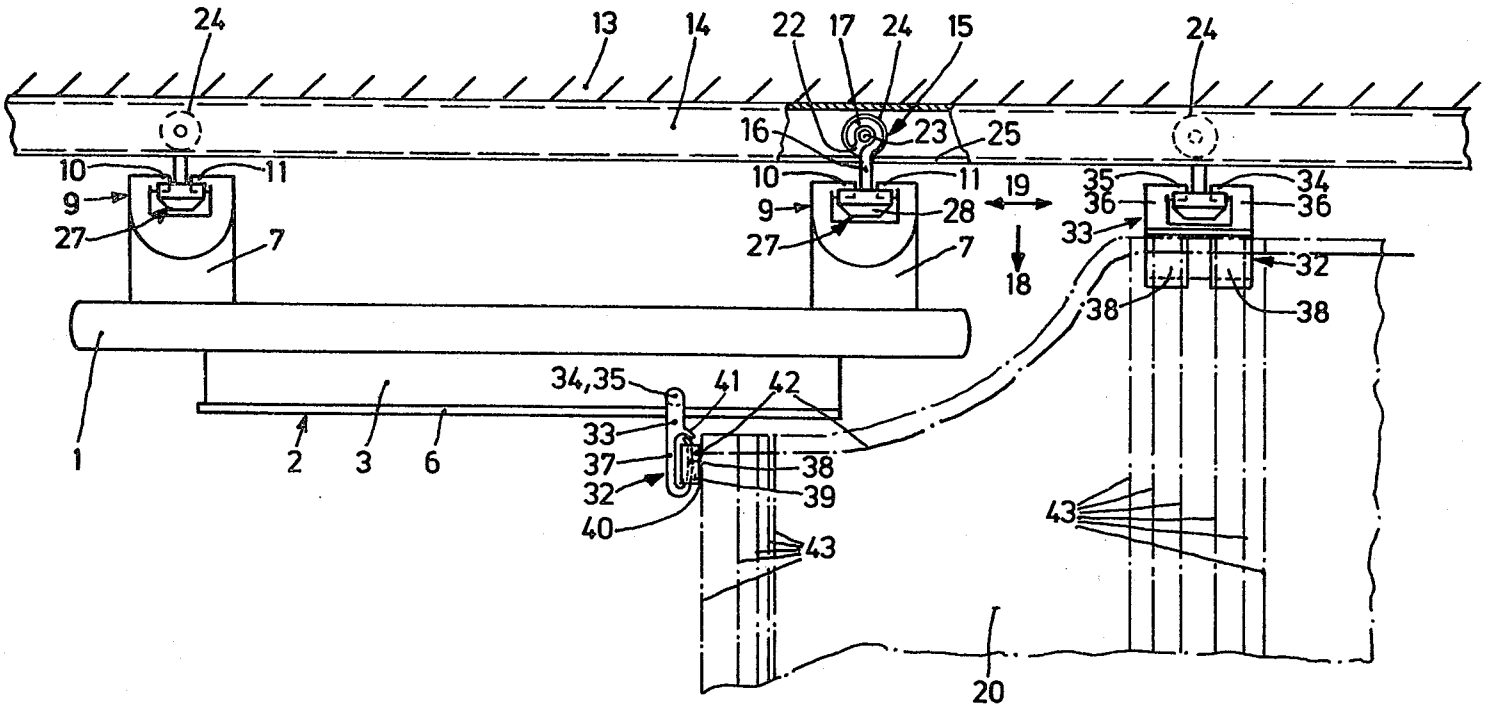
FIG. 3 is a partial cross-sectional view of the carrying member of the invention positioned on a mounted curtain or drape rail with the curtain or drape being partially suspended from the mounted rail and the carrying member.
Figure 4:
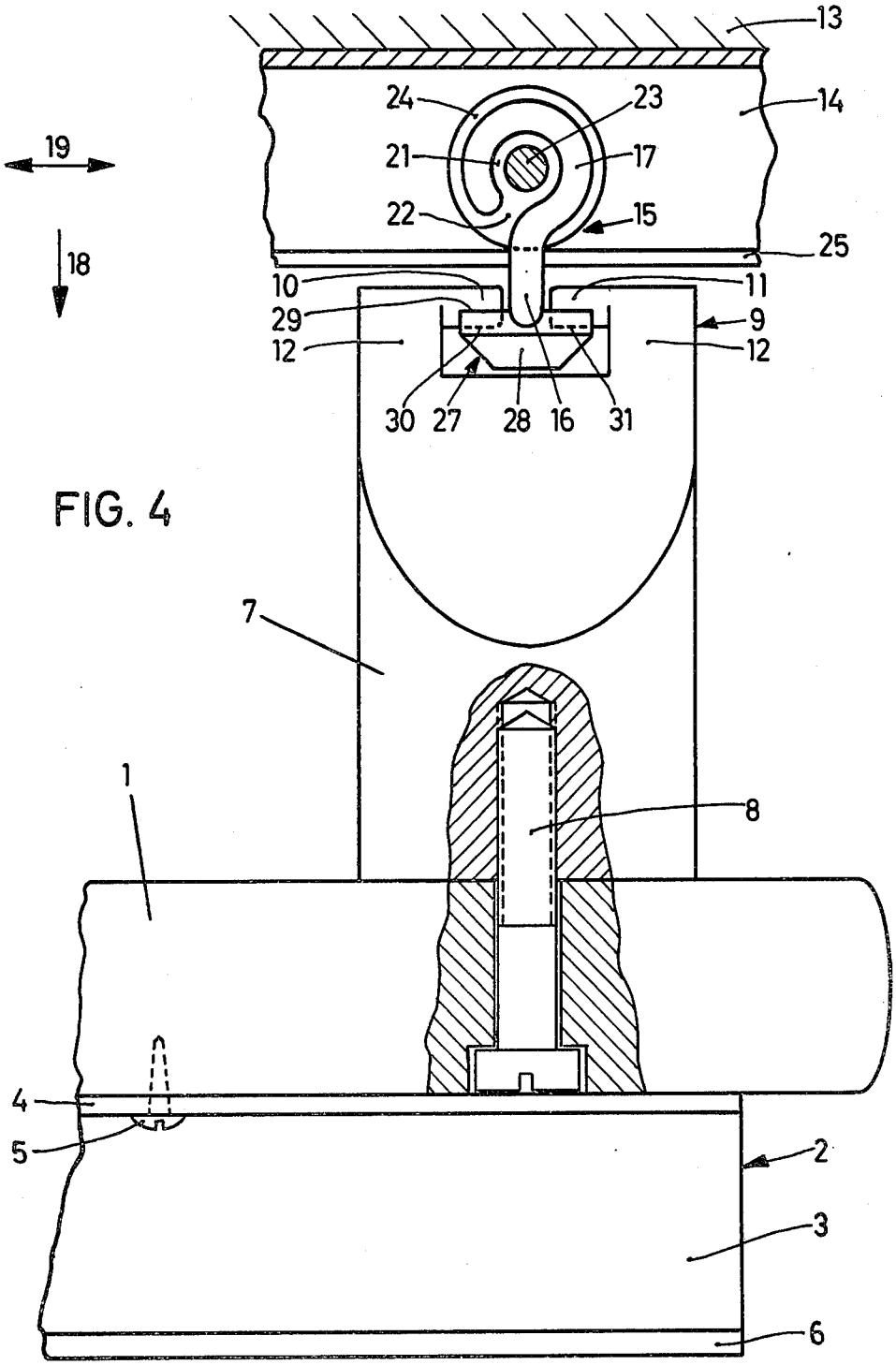
FIG. 4 is a partial cross-sectional view, on an enlarged scale, of the mounted carrying member of FIG. 3.

As shown in FIGS. 3 and 4, a curtain or drape rail 14 is mounted, for example, on a ceiling 13 of the room. The curtain rail 14 has a generally box-shaped cross-sectional configuration with the bottom of the rail being formed by two inwardly projecting arms 25 having free ends spaced from one another so as to define a longitudinally extending slot in the rail 14.

A plurality of hangers generally designated by the reference numeral 15 are arranged within the rail 14 with each hanger including a pair of rollers 24 which are joined together by a pin or axle 23 with the rollers 24 of each of the hangers 15 resting on inwardly directed arms 25 of the rail 14.

Each of the hangers 15 includes a hook 17, mounted on an upper end of a web 16, and a coupling member generally designated by the reference numeral 27. The entire hanger 15 is preferably molded of a thermoplastic hard-elastic synthetic resinous material.

The hook 17 defines a bore 21 and an obliquely oriented downwardly and outwardly extending slot or notch 22 having a width which is slightly less than the diameter of the pin 23. The bore 21 extends at right angles to both the normal hanging direction indicated by the arrow 18 of the curtain or drape 20 and the drape displacement direction indicated by the arrow 19, which direction is arranged at a right angle to the normal hanging direction 18.

By virtue of the material of the hanger 15, the slot or notch 22 widens elastically as the pin or axle 23 is pressed into the slot so as to permit the pin or axle 23 to be received in the bore 21 defined by the hook 17. With the pin or axle 23 arranged in the bore 21, the web 16 of the hanger 15 projects downwardly through the longitudinal slot in the curtain rail 14 defined between the projecting arms 25.

The coupling member 27 includes a coupling part 28 which is in the form of a truncated pyramid and, preferably, the coupling part 28 is a geometrical fragment of an equal angular pyramid having a square base. The coupling part 28 includes an upper large surface 29 provided with at least two recesses 30, 31 formed as a sector of a cylinder and, preferably, formed so as to be semicylindrical in shape and have an opening angle of at most 180°.

The recesses 30, 31 accommodate the aligned pins 10, 11 provided on the coupling part 9 in a manner more fully described in copending U.S. application Ser. No. 631,197 to which express reference is hereby made.

As shown in FIG. 3, the top edge of the curtain or drape 20 is disposed within a holding device generally designated by the reference numeral 32 which is provided at its upper end with a coupling member generally designated by the reference numeral 33. The coupling member 33 includes two aligned inwardly directed pins 34, 35 arranged on cheeks or lateral projections 36 provided on an upper face of the holding device 32.

Holding device 32 may be of a type disclosed in U.S. patent application Ser. No. 631,197 and may consist of a one-piece injected molded element of a thermoplastic synthetic resinous material. During the production of the holding device, two plate-shaped hooks 38 are formed and are adapted to receive loops 39 of a carrying tape 40 attached to a top edge of the curtain or drape 20. The top ends of the hook 38 are engaged behind a continuous nose-shaped edge 41 provided on the rear plate 37 with the edge 41 projecting in a forward and downward direction. The curtain or drape 20 is maintained in folds 43 by way of drawstrings 42 disposed in the carrier tape 40.

For the purpose of removing a curtain or drape 20 from the curtain rail 14, the carrying member 1 is coupled to the two hangers 15 disposed in the curtain rail 14 with the pins 10, 11 of the two coupling parts being accommodated in recesses 30, 31 of the coupling members whereby the carrying member 1 hangs below the curtain rail 14. The holding devices arranged at the top edge of the curtain or drape 20 are then removed from their associated hangers 15 in a manner more fully described in detail in U.S. application Ser. No. 631,197.

After a removal of the holding devices 32 from the rail 14, each of the devices is then turned 90° and inserted on the rail 2 of the carrying member 1 with the pins 34, 35 of the holding devices engaging over the cross webs of the rail 2. In this manner, the entire curtain or drape 20 is removed from the mounted curtain or drape rail 14 and received on the rail 2. The free ends of the rail 2 are then closed by conventional clip devices 44 so that the curtain or drape 20 cannot unintentionally become detached from the rail 2. The curtain or drape 20 can then be washed or cleaned, packed, stored or transported by suitably uncoupling the carrying member 1 from the associated hangers 15. The re-hanging of the curtains or drapes 20 is effected in the reverse sequence, namely, the carrying member 1 is mounted on hangers 15 of the rail 14 and the curtains or drapes are subsequently removed from the rail 2 to the mounted curtain or drape rail 14.

The carrying member 1 may be fashioned as a lid for covering an open top container such as disclosed in U.S. Pat. No. 3,917,065 and, for this purpose, the upper surface of the carrying member 1 may be provided with a suitable carrying handle (not shown) and a downwardly projecting rim or lip (not shown). If the carrying member 1 is used as a lid, the coupling members 9 may be integrally formed with the carrying member 1; however, in order to facilitate stacking of the containers, preferably the coupling members 9 are detachably arranged on the carrying member by suitable means such as screws 8 or the like.

As shown in FIGS. 5 and 6, a plurality of hangers generally designated by the reference numeral 15' may be arranged in the curtain or drape rail 14 with each of the hangers including a pair of rollers 24 joined together by a pin or axle 23 with the rollers of each of the hangers resting on inwardly directed arms 25 of the rail 14.

Each of the hangers 15' includes a hook 17, mounted on an upper end of a web 16 and a coupling member generally designated by the reference numeral 17'. The entire hanger 15' is preferably molded of a thermoplastic hard-elastic synthetic resinous material.

As with the hanger 15, the hook 17 defines a bore 21 and an obliquely oriented downwardly and outwardly extending slot or notch 22 having a width which is slightly less than the diameter of the pin 23. The lower portion of the hanger 15' includes a thickened or widened section 17' in which is fashioned a recess or bore 17'', the axis of which extends in the displacement direction 19 of the curtain or drape. The recess or bore 17'' is formed, in a direction toward a face side of the curtain or drape, with a slot 17''' extending approximately horizontally or slightly upwardly and outwardly as can be seen most clearly in FIG. 6. The two mutually aligned pins 10, 11 arranged on the top side of the suspension 7 engage or are received in the bore 17''.

The pins 10, 11 may have a circular cross-section, the diameter of which is somewhat larger than the width of the slot 17''' at the transition into the bore 17'' so that the pin 10, 11 can be introduced into the bore 17'' or removed therefrom only from the side through the slot 17''' under an elastic deformation of the thickened or widened portion 17'' and/or an elastic deformation of the pins 10, 11. The specific manner of engaging and disengaging the pins 10, 11 from the coupling member 9 is described in detail in U.S. application Ser. No. 631,197, to which express reference is made.

As shown in FIG. 7, a sliding hanger 15'', of the type disclosed in the afore-mentioned U.S. patent application, may be provided having at its lower end the coupling member 27 which includes a coupling part 28 fashioned as a truncated pyramid. The coupling part 28 is arranged on a web 16' of the hanger 15'' and projects downwardly through the longitudinal slot of a mounted curtain rail 14 defined between the projecting arms 25. As noted hereinabove, coupling member 27 is provided with recesses for accommodating the aligned pins 10, 11 of the suspension pin 7.

As shown in FIG. 8, a holding device 32' may be provided at the top edge of the curtain or drape and may have an approximately rectangular cross-sectional configuration. A middle or center web 48 projects forwardly from the relatively flat back portion 42 of the holding member 32' with tongues or webs 44 projecting from the middle web 48 in spaced parallel relationship to the back portion 42. A slot 45 which is open toward the top and bottom and toward the outside over its entire length is provided between two webs each and between a respective web 44 and back portion 42. While two slots 45 are illustrated, it is possible to provide three or more slot pairs or only a single pair of slots.

Tooth-like extensions or projections 46 are provided at the outer edges or rims of the webs 44 and at the edges of the back portion 42 facing the associated slots, whereby the mutually opposite projections coordinated to a respective slot alternately overlap in a manner such as described in U.S. Pat. No. 3,861,001, the disclosure of which is incorporated herein by reference to the extent to which it is necessary in understanding the present invention.

The holding device is provided at its upper end with a coupling member 33 in a manner more fully described in U.S. application Ser. No. 631,197.

While the curtain rail 14 has been described as having a box-shaped configuration, it is understood that such rail may also be of a T shape with the rollers of the respective hangers riding along the surfaces of the cross member of the T shape. Additionally, the sliding portion of the hangers 15 may have other configurations as, for example, an H-shaped configuration for receiving inwardly projecting arms of a box-shaped rail in a manner described in U.S. application Ser. No. 631,197.

While we have shown and described several embodiments in accordance with the present invention, it is understood that the same is not limited thereto, but is susceptible of numerous changes and modifications as known to those skilled in the art, and we therefor do not wish to be limited to the details shown and described herein, but intend to cover all such changes and modifications as are encompassed by the scope of the appended claims.

We claim:

1. An arrangement for packing, storing transporting and hanging ready-made curtains or drapes, the curtains or drapes provided at upper edges thereof with holding means for fixing folds or pleats, the holding means including coupling means arranged thereon for coupling the holding means with at least one of a plurality of hanger means arranged at a mounted curtain or drape rail, the hanger means including a further coupling means complementary to and cooperable with the coupling means of said holding means, characterized in that a carrying means is provided for carrying and accommodating an entire width of a curtain or drape, and in that means are provided at said carrying means for detachably coupling said carrying means to at least one of the hanger means.

2. An arrangement according to claim 1, characterized in that said means for detachably coupling said carrying means corresponds to the coupling means of one of the hanger means and the holding means.

3. An arrangement according to claim 1, characterized in that said means for detachably coupling said carrying means corresponds to the coupling means of the holding means.

4. An arrangement according to claim 3, characterized in that said means for detachably coupling said carrying means include at least one projecting coupling member arranged on a first surface of said carrying means.

5. An arrangement according to claim 4, characterized in that means are provided for detachably securing said at least one projecting coupling member to the first surface of said carrying means.

6. An arrangement according to claim 4, characterized in that said at least one projecting coupling member is integrally formed in one piece with said carrying means.

7. An arrangement according to claim 4, characterized in that means are provided on a second surface of the carrying means opposite the first surface for receiving the coupling means of said holding means.

8. An arrangement according to claim 7, characterized in that said means for receiving the coupling means is a curtain rail arranged on the second surface of the carrying means, said curtain rail having a length sufficient to accommodate an entire width of a curtain or drape.

9. An arrangement according to claim 1, characterized in that the coupling means of said holding means includes at least one coupling member having at least one connecting pin means arranged thereon, each of the coupling means of the hanger means includes at least one recess means therein for accommodating said at least one connecting pin means to couple a coupling member of the holding means to an associated hanger means, and in that said means for detachably coupling the carrying means to at least one of the hanger means includes at least one pin means arranged thereon adapted to be accommodated in a recess means of an associated hanger means.

10. An arrangement according to claim 9, characterized in that said at least one pin means is arranged on a coupling member disposed on a first surface of said carrying means.

11. An arrangement according to claim 10, characterized in that means are provided on a second surface of the carrying means for receiving said at least one connecting pin means of said holding means.

12. An arrangement according to claim 11, characterized in that said means for receiving said at least one connecting pin means of said holding means is a curtain rail, said curtain rail having a length sufficient to accommodate an entire width of a curtain or drape.

13. An arrangement according to claim 1, characterized in that the coupling means of the holding means includes at least one coupling member having at least two axially aligned connecting pin means, each of said coupling means of the hanger means includes at least two recess means therein for accommodating said at least two axially aligned connecting pin means to couple a coupling member of the holding means to an associated hanger means, and in that said means for detachably coupling said carrying means to the hanger means includes at least two spaced coupling members, each of which comprises at least two axially aligned pin means adapted to be accommodated in the recess means of an associated hanger means.

14. An arrangement according to claim 13, characterized in that each hanger means further includes a pair of spaced roller means joined by an axle means, a hook portion defining a bore means for receiving the axle means, means provided at said hook portion for permitting an insertion of the axle means into said bore means, and means for connecting the hook portion with the coupling means of the hanger means.

15. An arrangement according to claim 14, characterized in that the hanger means further includes a portion having the shape of a truncated pyramid with a larger surface and a smaller surface disposed in spaced parallel relationship, and in that said recess means are arranged in said larger surface of the pyramid-shaped portion.

16. An arrangement according to claim 15, characterized in that the holding means includes means for releasably securing an upper end of the curtain or drape thereto.

17. An arrangement according to claim 16, characterized in that said means for releasably securing an upper end of the curtain or drape includes at least two spaced plate-shaped hooks provided on said holding means, each of said plate-shaped hooks terminating in a free end, an edge means provided on said holding means for selectively clampingly engaging said free end of said plate-shaped hooks to secure the curtain or drape to the holding means.

18. An arrangement according to claim 15, characterized in that said holding means includes a flat back portion, a central web portion extending from said back portion, and a plurality of tongues projecting outwardly from said central web portion in spaced parallel relationship to each other and said back portion so as to define slots for accommodating portions of the drape or curtain to fix the folds or pleats therein.

19. An arrangement according to claim 1, characterized in that the coupling means of the holding means includes at least one coupling member having at least two axially aligned connecting pin means, each of the coupling means of the hanger means including one recess means for accommodating said at least two axially aligned connecting pin means to couple said coupling member of the holding means to an associated hanger means, and in that said means for detachably coupling said carrying means to the hanger means includes at least two spaced coupling member, each of which comprises at least two axially aligned connecting pin means adapted to be accommodated in said one recess means of an associated hanger means.

20. An arrangement according to claim 19, characterized in that each of the hanger means further includes a pair of spaced roller means joined by an axle means, a hook portion defines a bore means for receiving the axle means, means are provided at the hook portion for permitting an insertion of the axle means into said bore means, and means for connecting the hook portion with the coupling means of the hanger means.

21. An arrangement according to claim 1, characterized in that said hanger means is a sliding hanger provided with at least one surface portion slidably engaging the curtain or drape rail, the coupling means of said holding means includes at least one coupling member having at least two axially aligned connecting pin means, each of the coupling means of the hanger means includes at least two recess means therein for accommodating said at least two axially aligned connecting pin means to couple a coupling member of the holding means to an associated hanger means, and in that said means for detachably coupling said carrying means to the hanger means includes at least two spaced coupling members arranged on the carrying means with each coupling member comprising at least two axially aligned connecting pin means adapted to be accommodated in the recess means of an associated hanger means.

22. An arrangement according to claim 21, characterized in that means are provided on a surface of the carrying means opposite said spaced coupling members for receiving the coupling means of said holding means.

23. An arrangement according to claim 22, characterized in that said means for receiving the coupling means of the holding means is a curtain rail arranged on the carrying means, said curtain rail having a length sufficient to accommodate an entire width of a curtain or drape.

24. An arrangement according to claim 23, characterized in that the hanger means further includes a portion having the shape of a truncated pyramid with a larger surface and smaller surface disposed in spaced parallel relationship, and in that said recess means are arranged in said larger surface of the pyramid-shaped portion.

25. An arrangement according to claim 23, characterized in that the holding means includes means for releasably securing an upper end of the curtain or drape comprising at least two plate-shaped hooks provided on said holding means, each of said plate-shaped hooks terminating in a free end, and an edge means is provided on said holding means for selectively clampingly engaging said free end of the plate-shaped hooks to secure the curtain or drape to said holding means.

26. An arrangement according to claim 23, characterized in that said holding means includes a flat back portion, a central web portion extending from said back portion, and a plurality of tongues projecting outwardly from said central web portion in spaced parallel relationship to each other and said back portion so as to define slots for accommondating portions of the drapes or curtains to fix the folds or pleats therein.

* * * * *